United States Patent [19]

Chuang et al.

[11] Patent Number: 5,067,895

[45] Date of Patent: Nov. 26, 1991

[54] LIGHTER-ACTUATED BINGO MEANS

[76] Inventors: Jack Chuang; Tsung-Ping Lin, both of P.O. Box 55-1670, Taipei, Taiwan

[21] Appl. No.: 577,215

[22] Filed: Sep. 4, 1990

[51] Int. Cl.[5] ..... F23Q 1/00; F23D 14/00

[52] U.S. Cl. ..... 431/253; 431/126; 273/144 R; 273/148 R; 362/253

[58] Field of Search ..... 431/13, 14, 18, 125, 431/126, 253, 255; 273/144 R, 138 R, 138 A, 148 R, 269; 362/253; 131/270, 329

[56] References Cited

U.S. PATENT DOCUMENTS

| | | | |
|---|---|---|---|
| 4,034,988 | 7/1977 | Goldner et al. | 273/136 A |
| 4,311,448 | 1/1982 | Strauss | 431/14 |
| 4,948,361 | 8/1990 | Wu | 431/253 X |

FOREIGN PATENT DOCUMENTS

| | | | |
|---|---|---|---|
| 3505944 | 8/1986 | Fed. Rep. of Germany | 401/195 |
| 3534841 | 4/1987 | Fed. Rep. of Germany | 431/253 |
| 2610392 | 8/1988 | France | 431/125 |
| 0049619 | 4/1980 | Japan | 431/253 |
| 785954 | 11/1957 | United Kingdom | 431/253 |
| 1592729 | 7/1981 | United Kingdom | 431/253 |

*Primary Examiner*—Carl D. Price

[57] ABSTRACT

A bingo device includes: a gas lighter embedded in a holder casing having a lotto flash driver and a buzzer formed in the casing, whereby upon a ignition of the lighter by depressing a gas lever of the lighter, the lotto flash driver will be actuated for flashing plural lamps and also for sounding a buzzer for lighting, entertaining and playing purposes.

1 Claim, 2 Drawing Sheets

LIGHTER-ACTUATED BINGO MEANS

BACKGROUND OF THE INVENTION

A conventional gas lighter is provided for producing a naked flame to light cigarettes, etc. In order to enrich further uses of a gas lighter, a sounding device was provided in the lighter to produce single short sound when igniting a flame to entertain the lighter user. Or the lighter was mounted on a pen barrel or pen cap for both writing and lighting purposes.

It is therefore expected to disclose a gas lighter which can be ignited for producing a flame and also for actuating an integrated circuit for producing visual display and audio sound for entertaining and playing purpose.

SUMMARY OF THE INVENTION

The object of the present invention is to provide a bingo means including embedding a gas lighter in a holder casing having a lotto flash driver and a buzzer formed in the casing, whereby upon an ignition of the lighter by depressing a gas lever of the lighter, the lotto flash driver will be actuated for flashing plural lamps and also for sounding a buzzer for lighting, entertaining and playing purposes.

DETAILED DESCRIPTION

Figure 1:
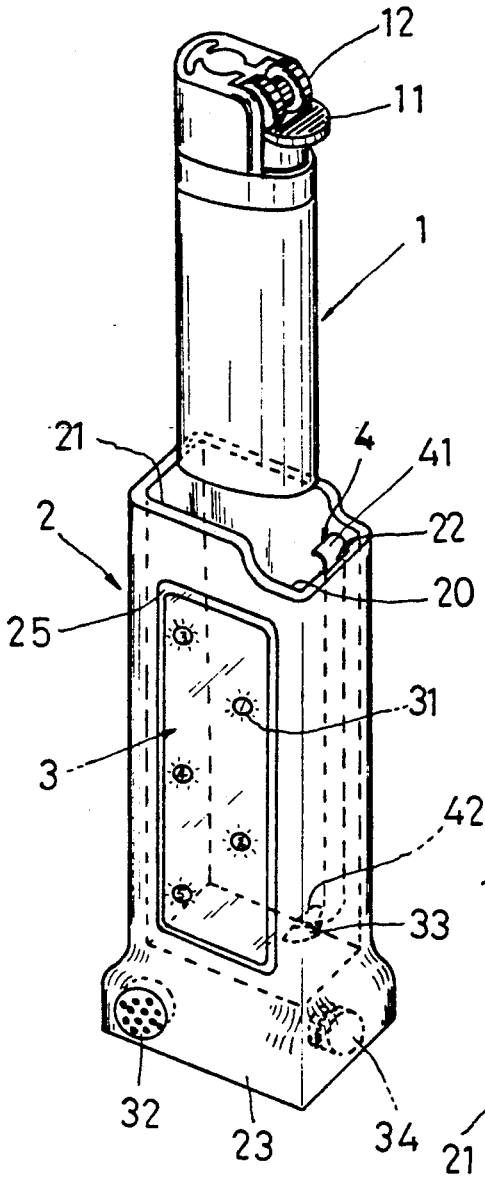
FIG. 1 is a perspective illustration of the present invention.

As shown in the figures, the present invention comprises: a gas lighter 1, a holder casing 2, a lotto flash driver 3, and a trigger means 4. The casing 2 is made of plastic material with electrical insulation property.

The gas lighter 1 includes a striker wheel 12 and a gas lever 11 in which the lever 11 is depressed to open a gas source and the wheel 12 is rotated for sparking and lighting a flame from the lighter 1 as its usual function. The gas lighter 1 is embedded into an elongate socket 21 formed in the holder casing 2 until seating on a base plate 24 formed in the bottom portion 23 of the casing 2.

Figure 3:
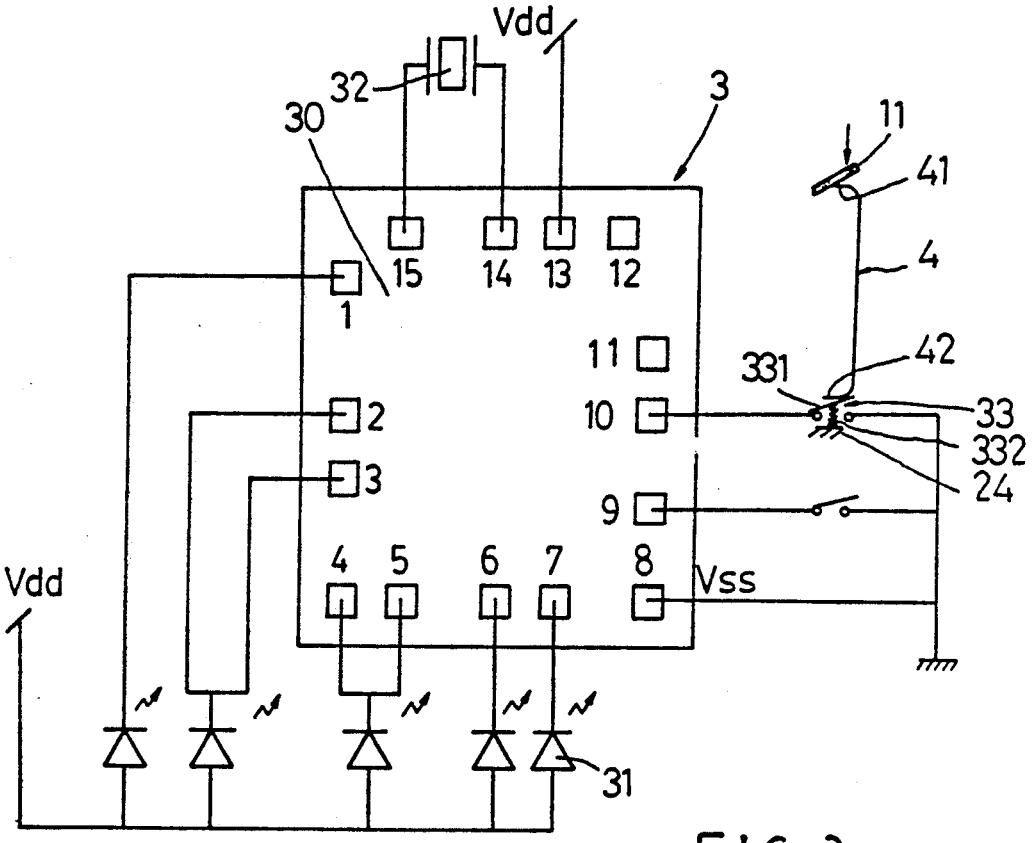
FIG. 3 is an electronic circuit showing the lotto flash driver of the present invention.

The lotto flash driver 3 especially as shown in FIG. 3 includes an integrated circuit (IC) 30 having a plurality of indicator lamps 31 such as light emission diodes connected to plural pins of the IC 30, a buzzer 32 for producing sound or music pre-memorized in the IC, a trigger switch 33 connected to one pin of IC 30, and a power source of batteries 34. The flash driver 3 may be formed as a printed circuit board (PCB) embedded on a side wall of the casing 2.

Figure 4:
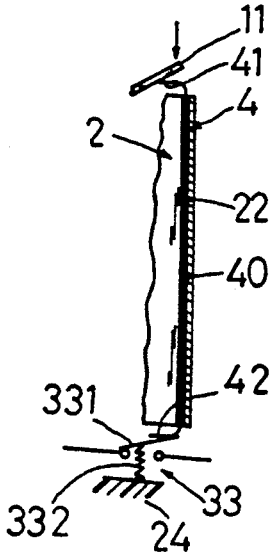
FIG. 4 shows a trigger means of the present invention.

The trigger means 4 includes: a slide plate 40 slidably held in a longitudinal groove 22 formed in a side wall of the holder casing 2, an upper bending portion 41 formed on an upper portion of the plate 40 bent inwardly to be operatively depressed by the gas lever 11 when igniting the gas lighter 1, and a lower bending portion 42 formed on a lower portion of the plate 40 bent inwardly and normally biased upwardly by a spring contactor 331 of the trigger switch 33 of the flash driver 3. For ensuring an elastic property, a small tensioning spring 332 may be further provided as shown in FIG. 4 to normally urge the lower bending portion 42 of the plate 40 upwardly. The upper bending portion 41 of the trigger means 4 normally protrudes upwardly beyond an opening edge 20 formed on an upper portion of the casing 2.

For decorating the PCB of flash driver 3 embedded on a side wall of the casing 2, a translucent cover 25 printed with a plurality of arabic numerals (1, 2, 3, 4, - - -) or any other figures (not shown) may be formed on the outer surface of the PCB of driver 3. The figures or features printed on the cover 25, the shapes of the present invention, and kinds of lamps, and sound produced by the integrated circuit are not limited in this invention.

In installing the present invention, the gas lighter 1 is embedded into socket 21 of the casing 1 until seating on the base plate 24 formed on a bottom portion 23 of the casing 2. By inserting the upper bending portion 41 of the trigger means 4 to be under the gas lever 11 of the lighter 1. The slide plate 40 of the trigger means 4 is normally urged upwardly by the spring contactor 331 of the trigger switch 33 of the flash driver 3 or urged by the spring contactor 331 which is further resiliently held by a tensioning spring 332 as shown in FIG. 4. Two poles of the power source of batteries 34 are respectively connected to pins of Vdd, Vss of the integrated circuit 30 of driver 3. The buzzer 32 and batteries 34 are preferably mounted inside the bottom portion 23 of the casing 2.

When depressing the gas lever 11 of the lighter 1 to ignite a flame, the upper bending portion 41 of the trigger means 4 is also depressed downwardly to close the contactor 331 of the trigger switch 33 to trigger the IC 30 for flashing the plural lamps 31 such as numerals 1, 2, 3, 4, 5 as shown in FIG. 1 and also for producing sound comprised of a plurality of single short sound signals through the buzzer 32. The flashing illumination of lamps 31 will finally stop at any optional single lamp among the plural lamps for continuous illumination and the single sound signals will also be changed to be a music melody continuously played through the buzzer 32 for interesting bingo or lotto function. The continously illuminating along with music sounding at a lamp is randomly operated which can be chosen from any commercial avaiable integrated circuit, such as integrated circuit HT-2070 produced by HOLTEK Semiconductor Inc., Taiwan.

Each time depression of the lighter lever 11 to trigger the IC 30, the finally illuminating with music sounding lamp 31 is random and variable for enriching the player's interest, like a bingo or lotto game.

Figure 2:
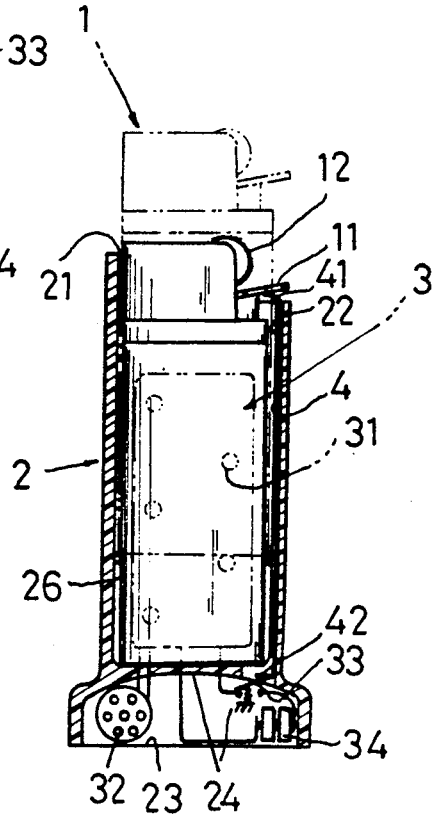
FIG. 2 is an illustration when embedding the lighter in the holder casing in accordance with the present invention.

At least two protrusions 26 are formed on two opposite side walls inside the casing 2 above the trigger switch 33 as shown in FIG. 2 so that the lighter 1 can be pulled upwardly as shown in dotted line of FIG. 2 to be temporarily engaged or limited on the two protrusions 26 to prevent a sounding and flashing operation of the present invention when the sounding is not expected, especially in a silent office.

The protrusion 26 may be made of resilient so that when further force is acted on the lighter 1, the lighter 1 will be disengaged from the protrusions 26 and depressed downwardly until seating on the base plate 24 as solid line shown in FIG. 2, for normally depressing and sounding operation.

The present invention is therefore served as an interesting lotto or bingo game, besides its lighing or igniting purpose.

The present invention may be further modified by those skilled in the art without departing from the spirit and scope of this invention.

After releasing the lever 11 of lighter 1, the slide plate 41 of trigger means 4 will be resiliently urged upwardly to open the switch 33 to switch off the circuit of flash driver 3. Of course, the flash driver 3 may be continuously flashing or sounding for preset time duration even the switch 33 is switched off, and then stop after the preset time period is over.

We claim:

1. A lighter-actuated bingo means comprising:

a gas lighter having a gas lever formed in the gas lighter embedded in a socket of a holder casing;

a lotto flash driver including an integrated circuit formed on an integrated circuit board embedded on a side wall of said holder casing, a plurality of indicator lamps connected to said integrated circuit, a buzzer connected to said integrated circuit, a trigger switch formed on a base plate formed in a bottom portion of said holder casing for triggering the integrated circuit for flashing said lamps and sounding said buzzer, and a power source of batteries for powering said integrated circuit, said lamps and said buzzer; and a trigger means formed on a side wall of said holder casing operatively depressed by said gas lever of said gas lighter to close said trigger switch of said flash driver for flashing the lamps and sounding the buzzer, the improvement which comprises:

said trigger means including a slide plate slidably mounted in a longitudinal groove formed in a side wall of said holder casing, an upper bending portion formed on an upper portion of said slide plate normally protruding upwardly above an opening edge formed on an upper portion of said casing and bent inwardly under said gas lever to be operatively depressed by said lever, and a lower bending portion formed on a lower portion of said slide plate and bent inwardly to be normally resiliently urged upwardly by a spring contactor of said trigger switch, said spring contactor of said trigger switch upwardly urged by a tensioning spring to urge said slide plate upwardly to be operatively depressed by said gas lever.

* * * * *